US007097257B2

(12) United States Patent
Stehney

(10) Patent No.: US 7,097,257 B2
(45) Date of Patent: Aug. 29, 2006

(54) CUTTING TOOL WITH NOZZLE FOR SPRAYING WATER ON CUTTER BIT

(75) Inventor: Stephen C. Stehney, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 10/940,976

(22) Filed: Sep. 15, 2004

(65) Prior Publication Data

US 2006/0055229 A1 Mar. 16, 2006

(51) Int. Cl.
*E21C 35/187* (2006.01)

(52) U.S. Cl. ..... 299/81.3

(58) Field of Classification Search ..... 299/81.1, 299/81.2, 81.3, 102–107, 110–111
See application file for complete search history.

(56) References Cited

U.S. PATENT DOCUMENTS 4,333,687 A 6/1982 Barnstorf
4,678,238 A * 7/1987 Emmerich ..... 299/81.1
4,915,454 A * 4/1990 Southern ..... 299/108
6,099,081 A 8/2000 Warren et al.
6,485,104 B1 11/2002 Keller

FOREIGN PATENT DOCUMENTS

GB 2 092 205 8/1982
SU 1550126 * 3/1990

* cited by examiner

*Primary Examiner*—Sunil Singh
(74) *Attorney, Agent, or Firm*—Drinker Riddle & Reath LLP

(57) ABSTRACT

A holder block is mounted on a carrier and has formed therein a first hole and a water passage. A sleeve is mounted in the first hole and receives a cutter bit. The sleeve includes a shank and an enlarged flange disposed at a front end thereof. The shank is disposed in the first hole. The flange includes a rearwardly facing shoulder bearing against an outer surface of the block. A second hole extends through the shank and the flange and is adapted to receive the cutter bit. A spray nozzle is disposed in the flange and is connected to the water passage by way of an annular groove, for receiving water which it sprays forwardly against the cutter bit.

16 Claims, 1 Drawing Sheet

CUTTING TOOL WITH NOZZLE FOR SPRAYING WATER ON CUTTER BIT

BACKGROUND OF THE INVENTION

The present invention relates to a cutting tool for use especially in mining and road-working environments, which include a nozzle for spraying water onto a cutter bit.

Drum-type cutters are conventional in the mining and road-working industries for example, wherein cutter bits are mounted on a drum which rotates about a horizontal axis. Such cutters can be used to cut through minerals in a mine, or to rip up asphalt or concrete from a roadway, among other uses. The cutter bits, which are carried by holder blocks welded to the outer surface of the drum, are rotatable about their own longitudinal axes so as to be self-sharpening. During a cutting operation, not only do the bits tend to wear, but the holder blocks wear as well. That is, the area of the holder block that surrounds the bit-receiving bore wears due to abrasion thereof by the materials being cut. It will be appreciated that the need to replace the welded-on holder blocks results in a serious expenditure of time and money.

To minimize that problem, it has been proposed to mount each cutter bit in a replaceable hollow sleeve which is inserted into a respective holder block. The sleeve includes a wide flange that overlies the area of the holder block that surrounds the mouth of the bit-receiving bore, and thereby shields the holder block from appreciable wear. Instead, the sleeves become worn and are replaced when necessary.

It is also conventional to provide the drum or the blocks with nozzles that spray water in the direction of the cutter bits for cooling and flushing purposes. The cooling feature is especially beneficial in mining environments where explosive gases, such as methane, may be present. The presence of such gases presents the risk of explosions in response to so-called "friction ignition" wherein friction imposed against steel parts of the cutter bits produces beads of molten steel, the heat of which ignites the gases. By spraying cooling water against the cutter bit, the potential for such friction ignition is greatly reduced. The cooling water also extinguishes ignitions (normally occurring at the bit tip), and controls dust.

Examples of providing spray nozzles in the block can be found in U.S. Pat. Nos. 4,333,687; 6,099,081; 6,485,104; and British Patent 2092205.

It will be appreciated from U.S. Pat. No. 4,333,687 that the provision of a nozzle immediately next to the cutter bit requires that the diameter of the flange portion of the replaceable sleeve be greatly reduced, thereby diminishing the amount of wear protection afforded thereby.

The provision of spray nozzles in an extension of the block, as in U.S. Pat. Nos. 6,099,081; and 6,485,104 serves to increase the amount of wearable surface area of the block and also displaces the nozzles farther from the cutter bit.

The provision of a nozzle in a separate bushing that surrounds the sleeve, as disclosed in British Patent 2092205, adds further cost and complexity to the system and places the nozzle somewhat laterally remote from the cutter bit.

It would be desirable to provide a nozzle for such a cutter bit which is positioned close to the cutter bit without adversely affecting the wear protection afforded by the replaceable flange.

In U.S. Pat. No. 4,678,238 there is disclosed a rotary mining bit rotatably mounted in a sleeve that is secured in a holder block. The sleeve is in the form of a two-step sleeve that is received in a two-step bore of the holder block, wherein the sleeve is fully recessed in the holder block. A coolant passage is formed in the holder block and communicates with an annular passage formed between the bore and the sleeve. The annular passage communicates with a water spray passage extending through a large-diameter portion of the sleeve. A roll pin extends through the aligned holes of the holder block and the sleeve to prevent rotation of the sleeve. The water spray passage is oriented to spray water toward a tip of the bit. However, because of the need to position the roll pin in aligned holes of the holder block and the sleeve, the sleeve (and thus the water spray passage) can be placed in only one orientation relative to the holder block, which might not be optimal for the particular location of the holder block on the mobile carrier (e.g., rotary drum). Also, because the sleeve is fully recessed within the bore, it offers no protection for the holder block against adhesive wear by cuttings.

It would be desirable to provide such a nozzle in a sleeve which protects the mounting block from abrasive wear by cuttings.

It would be further desirable to ensure that the nozzle can always be oriented in an optimal spray location, regardless of the particular location of the mounting block on the carrier.

SUMMARY OF THE INVENTION

The present invention relates to an assembly comprising a holder block and a sleeve. The holder block has formed therein a first hole and a water passage. The sleeve is mounted in the first hole for receiving a cutter bit. The sleeve includes a shank, an enlarged flange, a second hole, and a spray nozzle. The shank is disposed in the first hole. The enlarged flange is disposed at a front end of the shank and includes a rearwardly facing shoulder for bearing against an outer peripheral surface of the block. The second hole extends within the shank and the flange and is adapted to receive a cutter bit. The spray nozzle is disposed in the flange and is connected to the water passage for receiving water therefrom. The nozzle is oriented to spray water in a generally forward direction. The sleeve is adjustable to numerous positions of adjustment about a longitudinal axis defined by the first hole and is held against rotation about the axis in each position of adjustment.

Preferably, the water passage extends to an interface formed between the shoulder and the block's outer surface. An annular groove is disposed in the interface in surrounding relationship to the second hole. The groove communicates with both the water passage and the nozzle. The invention also pertains to the sleeve per se having a water passage formed in a flange thereof.

BRIEF DESCRIPTION OF THE DRAWINGS

The objects and advantages of the invention will become apparent from the following detailed description of preferred embodiments thereof in connection with the accompanying drawings in which like numerals designate like elements.

DETAILED DESCRIPTION OF A PREFERRED EMBODIMENT

Figure 3:
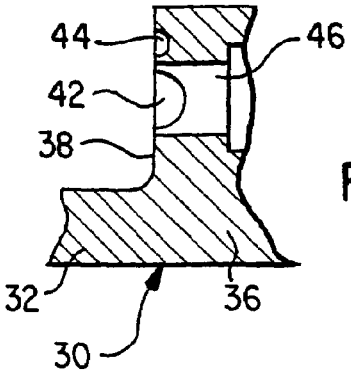
FIG. 3 is an enlarged fragmentary view of a portion of the flange.
Figure 1:
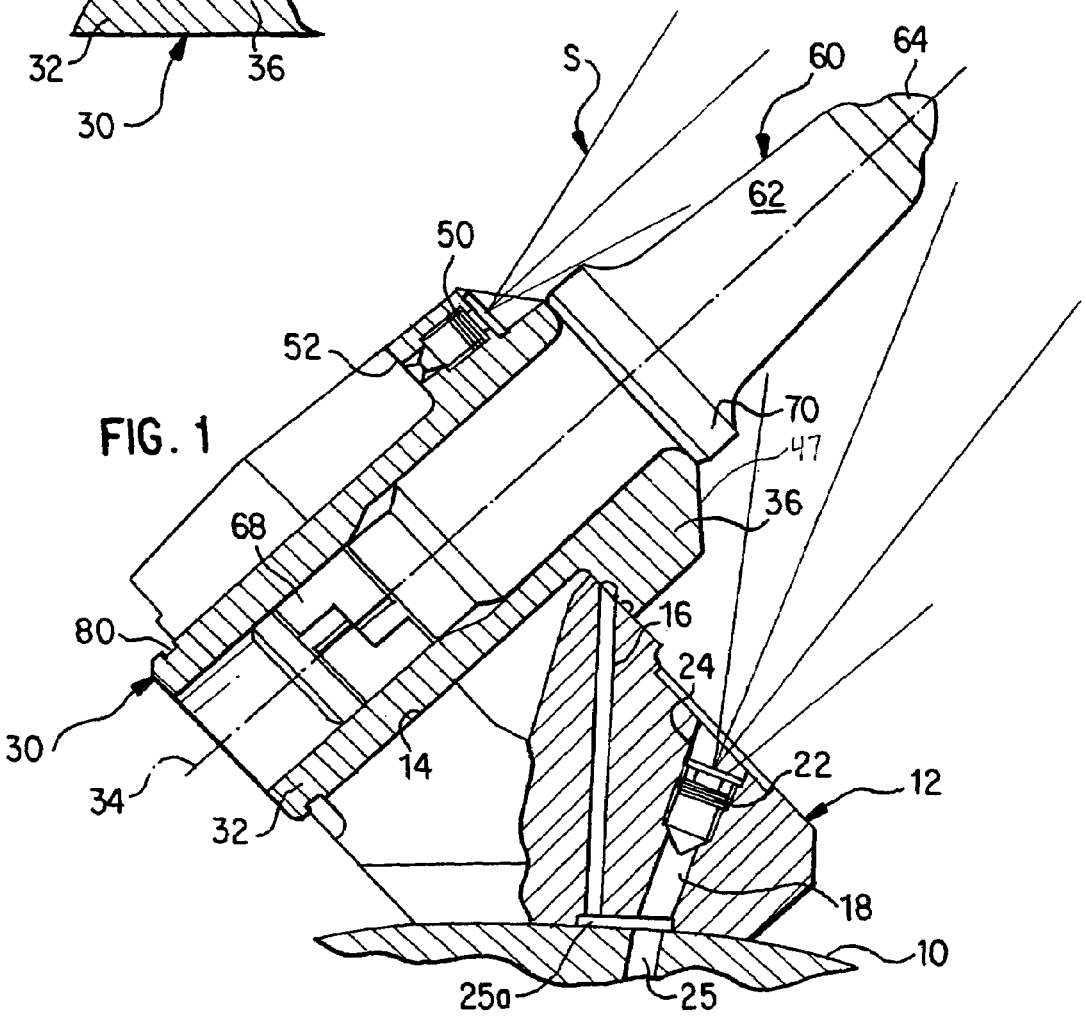
FIG. 1 is a cross-sectional view through a portion of a drum, a holder block mounted on the drum, and a sleeve disposed in the holder block.

Shown in FIG. 1 is a tool assembly mounted on a mobile carrier such as a drum 10, although the carrier could comprise an endless chain or even a non-rotatable carrier.

Figure 2:
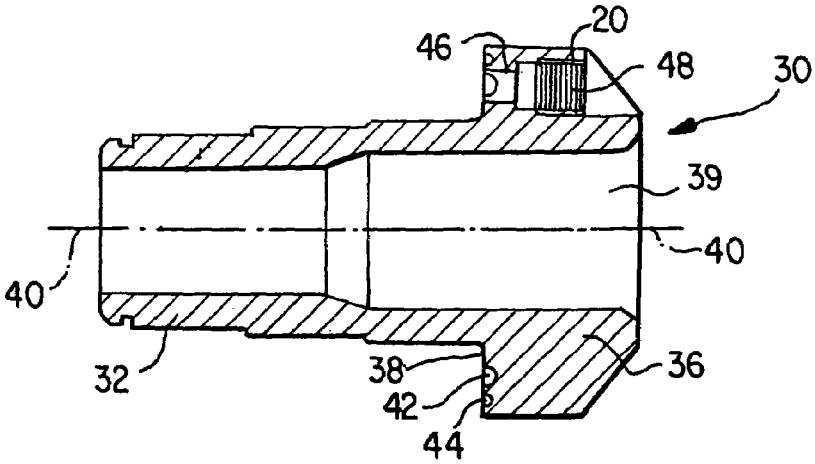
FIG. 2 is a cross-sectional view taken through the sleeve shown in FIG. 1.

Mounted on the exterior of the drum 10 are holder blocks (only one being depicted). The holder block 12 includes a hole that can be a through-hole or a blind hole, but is preferably in the form of a through-bore 14. The holder also includes a liquid passage 16, and at least one fluid channel 18. The channel 18 (or each channel 18 in the case of plural channels) has an internal screw thread 20 formed therein (FIG. 2) for receiving a nozzle element 22 (FIG. 1).

The channel 18 opens in a front portion of an outer peripheral surface 24 of the block 12, so that the nozzle is directed in a generally forward direction.

The channel 18 communicates with a water supply conduit 25 disposed in the drum 10 so that fluid, such as water, can be conducted to the nozzle 22 to be sprayed forwardly. The water passage 16 and the fluid channel 18 extend toward an outer rear surface of the block and are interconnected by a bridge passage 25*a* formed in that outer rear surface. The bridge channel 25*a* connects with the main water supply conduit.

The fluid passage 16 extends to the front peripheral surface 24 of the block and intersects that surface at a location which is overlaid by a front flange 36 of a sleeve 30 that is mounted in the through-bore 14. The sleeve 30 also includes a shank 32 that defines a longitudinal center axis 34, and which extends rearwardly from the enlarged flange 36. The shank 32 and the through-bore 14 can be of any desired cross sectional shape. The flange 36 forms a rearwardly facing shoulder 38 which abuts the block's surface 24. A hole such as a through-hole or a blind hole, but preferably in the form of a bore 39 extends through the sleeve and defines a center longitudinal axis 40 that coincides with the center axis of the through-bore 14.

The shoulder 38 engages the outer peripheral surface 24 of the holder block, so that the flange 36 protects that outer surface against abrasive wear during a cutting operation.

Formed in the flange's shoulder 38 are first and second annular grooves 42, 44, each of which surrounds the bore 39 coaxially therewith. The groove 42 constitutes an inner groove in the sense that it is disposed radially inside of the second groove 44. As shown in FIG. 1, the inner groove 42 intersects the fluid passage 16.

Formed in the flange 36 is at least one second nozzle channel 46 that extends from the shoulder 38 to a forwardly facing surface 47 of the flange. The channel 46 has internal screw threads 48 formed therein for receiving a screw-in nozzle 50 arranged to spray water forwardly. The channel 46 intersects the inner groove 42 and thus communicates with the fluid passage 16.

Mounted in the sleeve 30 is a conventional cutter bit 60 which comprises a steel body 62 and a hard (e.g. carbide) cutting tip 64. The body 62 is mounted in the sleeve's bore 39 by a conventional split retainer 68 which resists axial dislodgement of the cutter bit while permitting the cutter bit to freely rotate about its center axis. A shoulder 70 of the body 62 abuts the flange 36 to limit the extent of axial inward movement of the cutter bit.

During a cutting operation, the drum is rotated, and the cutter bits rip through the material being cut, e.g., roadway asphalt, or minerals in a mine.

A cooling and flushing action is produced by the water spray S being directed toward the cutter bit from the nozzles 22, 50.

Accordingly, water which is conducted through the drum passage 25 is delivered to the block-mounted nozzle 22 (via channel 18) as well as the flange-mounted nozzle 50 via the passage 16, the groove 42 and the channel 46. One or more additional channels 46 and associated nozzles 50 could be provided in the flange 36, if desired.

The outer groove 44 is adapted to receive a sealing ring 52 which encircles the bore 14 to prevent the egress of water being conducted to the inner groove 42.

It will be appreciated that by positioning a nozzle within the flange 35, the nozzle is able to spray water very close to the cutter bit, without sacrificing the wear protection afforded by the flange, and without having to add extension elements to the holder block.

Moreover, by conducting water to the nozzle 50 via a passageway 16 and an annular groove 42, it is possible to rotate the sleeve about the axis 34 in order to adjust the nozzle 50 at different angular positions relative to the holder block, as may be dictated depending upon the particular location of the respective holder block on the drum. Although the annular grooves 42 and 44 are depicted as formed in the shoulder 38 of the flange 36, either or both could instead be formed in the surface 24 of the holder block. Either way, the groove would be located at an interface between the flange and the holder block, enabling the nozzle to be adjusted by rotating the flange.

The sleeve 30 can be held in the through-bore 14 in any suitable annular position about the axis 62, e.g., by a retainer clip (not shown) disposed in respective recesses 80 formed in a rear end of the sleeve, and/or by an interference fit. Thus, once inserted, the sleeve is fixed against rotation relative to the holder block.

Although the holder block 12 has been disclosed as mounted on a rotary drum, it could instead be mounted on any suitable type of carrier, such as on an endless chain of a trencher, or even on a non-rotary carrier such as a board fixed to a vehicle.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. An assembly comprising:

a holder block having formed therein a first hole and a water passage, the first hole defining a longitudinal axis; and a sleeve mounted in the first hole for receiving a cutter bit, the sleeve including:

a shank disposed in the first hole, an enlarged flange disposed at a front end of the shank and including a rearwardly facing shoulder bearing against an outer peripheral surface of the block, the flange having an annular groove formed therein and surrounding the first hole, a second hole extending within the shank and the flange and adapted to receive a cutter bit, and a spray nozzle disposed in the flange and connected to the water passage by the annular groove for receiving water therefrom, the nozzle oriented to spray water in a generally forward direction, the sleeve being adjustable to numerous positions of adjustment about the longitudinal axis and held against rotation about the axis in each position of adjustment.

2. The assembly according to claim 1 further including an annular sealing ring disposed between the shoulder and the outer surface of the block in surrounding relation to the first and second holes, with the nozzle disposed interiorly of the seal ring.

3. The assembly according to claim 1, further including the cutter bit, wherein the spray nozzle is oriented to spray water generally towards the cutter bit.

4. The assembly according to claim 1 wherein the shank is secured in the first hole by an interference fit.

5. The assembly according to claim 1 wherein the shank is secured in the first hole by a non-interference fit and further including a retainer for preventing the shank from becoming axially dislodged from the first hole and from rotating within the first hole.

6. An assembly comprising:

a holder block having formed therein a first hole and a water passage, the first hole defining a longitudinal axis;

a sleeve mounted in the first hole for receiving a cutter bit, the sleeve including:

a shank disposed in the first hole, an enlarged flange disposed at a front end of the shank and including a rearwardly facing shoulder bearing against an outer peripheral surface of the block, a second hole extending within the shank and the flange and adapted to receive a cutter bit, and a spray nozzle disposed in the flange and connected to the water passage for receiving water therefrom, the nozzle oriented to spray water in a generally forward direction, the sleeve being adjustable to numerous positions of adjustment about the longitudinal axis and held again rotation about the axis in each position of adjustment; and an annular sealing ring disposed between the shoulder and the outer surface of the block in surrounding relation to the first and second holes, with the nozzle disposed interiorly of the seal ring, wherein the water passage extends to an interface formed between the shoulder and the block's outer surface, there being an annular groove disposed in the interface in surrounding relationship to the second hole, the groove communicating with both the water passage and the nozzle.

7. The assembly according to claim 6 wherein the annular groove is formed in the shoulder.

8. The assembly according to claim 6, further including a second nozzle disposed in the holder block for spraying water generally forwardly.

9. The assembly according to claim 8 wherein the block includes a fluid channel leading to the second nozzle, the water passage and the fluid channel extending toward an outer surface of the block and being interconnected by a bridge passage formed in the outer surface.

10. An assembly comprising:

a mobile carrier having main water supply conduit formed therein for conducting water;

a holder block fixed on the carrier and having formed therein a first hole, a water passage, and a fluid channel, the first hole defining a longitudinal axis; and a sleeve mounted in the first hole for receiving a cutter bit, the sleeve including:

a shank disposed in the first hole, an enlarged flange disposed at a front end of the shank and including a rearwardly facing shoulder bearing against a surface of the block, a second hole extending within the shank and the flange and adapted to receive a cutter bit, a first spray nozzle disposed in the flange and connected to the water passage for receiving water therefrom, the nozzle oriented to spray water in a generally forward direction;

wherein the water passage extends to a first interface formed between the shoulder and the block's outer surface, there being an annular groove disposed in the first interface in surrounding relationship to the second hole, the groove communicating with both the water passage and the nozzle;

the sleeve being adjustable to numerous positions of adjustment about the longitudinal axis and held again rotation about the axis in each position of adjustment; and a second spray nozzle disposed in the fluid channel and oriented to spray water generally forwardly, wherein the water passage and the fluid channel extend to a second interface formed between the block and the carrier, there being a bridge passage disposed in the second interface which communicates the main water supply conduit with both the fluid channel and the water passage.

11. The assembly according to claim 10, wherein the annular groove is formed in the shoulder.

12. The assembly according to claim 10, further including the cutter bit, wherein at least one of the first and second spray nozzles is oriented to spray water generally towards the cutter bit.

13. The assembly according to claim 10 wherein the rearwardly facing shoulder of the flange bears against an outer peripheral surface of the block.

14. The assembly according to claim 10 wherein the shank is secured in the first hole by an interference fit.

15. A sleeve adapted to be mounted in a holder block to receive a cutter bit, the sleeve including:

a shank, an enlarged flange disposed at a front end of the shank and including a rearwardly facing shoulder, a hole extending within both the shank and the flange, a fluid conducting channel extending through the flange from the rear shoulder to a forwardly facing surface, and a nozzle mounted in the fluid conducting channel, wherein the rear shoulder includes an annular groove surrounding the hole, and the channel intersects the annular groove.

16. The sleeve according to claim 15, wherein the groove constitutes a first groove, and further including a second groove surrounding the first groove and adapted to receive a sealing ring.

* * * * *